US007411597B2

(12) United States Patent
Noguchi et al.

(10) Patent No.: US 7,411,597 B2
(45) Date of Patent: Aug. 12, 2008

(54) IMAGE FORMING APPARATUS

(75) Inventors: Junichi Noguchi, Jiangsu Province (CN); Katsumi Takahashi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/745,649

(22) Filed: May 8, 2007

(65) Prior Publication Data

US 2007/0268358 A1 Nov. 22, 2007

(30) Foreign Application Priority Data

May 16, 2006 (JP) ..... 2006-136961

(51) Int. Cl.
*G03G 15/00* (2006.01)

(52) U.S. Cl. ..... 347/116; 347/234; 347/248; 347/249; 399/301; 399/302

(58) Field of Classification Search ..... 347/116, 347/234, 248, 249; 399/297–302
See application file for complete search history.

(56) References Cited

U.S. PATENT DOCUMENTS 5,515,145 A * 5/1996 Sasaki et al. ..... 399/302
5,872,586 A 2/1999 Shio
7,221,894 B2 * 5/2007 Kishi ..... 399/302

FOREIGN PATENT DOCUMENTS

JP 10-003188 A 1/1998

* cited by examiner

*Primary Examiner*—Huan H Tran
(74) *Attorney, Agent, or Firm*—Canon U.S.A., Inc. I.P. Division

(57) ABSTRACT

An image forming apparatus includes an intermediate transfer member position detection unit configured to detect a position of the intermediate transfer member to output an image forming operation start signal, a pattern detection unit configured to detect a registration correction pattern formed on the intermediate transfer member based on the image forming operation start signal, a misregistration variation detection unit configured to read the registration correction pattern detected by the pattern detection unit based on the image forming operation start signal and to generate a reference clock signal based on the read registration correction pattern, and a polygonal mirror drive motor control unit configured to adjust a rotation speed of the polygonal mirror drive motor based on the reference clock signal generated by the misregistration variation detection unit.

8 Claims, 10 Drawing Sheets

IMAGE FORMING APPARATUS

BACKGROUND OF THE INVENTION

1. Field of the Invention

The present invention relates to an image forming apparatus which transfers a visible image having a plurality of colors onto a transfer material which is carried by an endless-belt-type transfer material conveying member or onto an endless-belt-type intermediate transfer member to form a multicolor image.

2. Description of the Related Art

Conventionally, there is known an image forming apparatus which emits light modulated by an image signal to form an electrostatic latent image on a photosensitive drum serving as an image carrier, develops the electrostatic latent image with developers of respective colors to form a toner image of the electrostatic latent image, and transfers the toner image onto a transfer material directly or through an intermediate transfer belt. This apparatus is referred to as a single-drum type color image forming apparatus.

Also, there is known an image forming apparatus having four image forming sections, each section including a photosensitive drum associated with one of four colors and an electrophotographic process unit disposed in the periphery of the photosensitive drum. Toner images formed by the respective image forming sections are transferred onto a transfer material directly or through an intermediate transfer belt. This apparatus is referred to as a multi-drum type color image forming apparatus.

Since the multi-drum type color image forming apparatus transfers images in a multiplexed manner, there is a concern about the so-called "color misregistration". The color misregistration occurs when color images formed on the respective photosensitive drums become out of registration on the transfer material due to various reasons, such as a mechanical mounting error between the photosensitive drums, an optical path length error between laser beams, or an optical path variation between laser beams.

A technique generally employed to correct color misregistration includes forming a color misregistration correction pattern on an intermediate transfer member (intermediate transfer belt) or a transfer material conveying belt, and then detecting the pattern with a photosensor serving as a pattern detection unit arranged adjacent to a photosensitive drum at the most downstream side of the image forming section. In this way, color misregistration is detected based on the color misregistration correction pattern, and an image signal which is to be recorded can be corrected electrically. Also, there is another color misregistration correction technique in which a folding mirror located in a laser beam path is driven to automatically correct a change in an optical path length or a change in an optical path.

The techniques described above relate to a stationary color misregistration with respect to misregistration of a color misregistration correction pattern. Japanese Patent Application Laid-Open No. 10-3188 discusses a positive approach to correcting a variable misregistration or an uneven pitch occurring at certain regular intervals.

To be more specific, (1) a stationary misregistration correction pattern and a periodic misregistration correction pattern are formed so that periodic misregistration and uneven pitch as well as stationary misregistration can be corrected. Also, (2) a rotation variation of a photosensitive drum or a transfer material conveying belt is detected, and the rotation speed of a polygonal mirror is controlled based on the detected speed variation.

However, regarding the aforementioned technique (1), the periodic misregistration is due not only to one body of rotation but to a combination of a plurality of bodies. Thus, even if a periodic misregistration in the photosensitive drum is corrected, misregistration due to other factors cannot be corrected.

Also, regarding the aforementioned technique (2), misregistration is due not only to a speed variation of a body of rotation but also to an eccentricity of a roller which drives the photosensitive drum or the transfer material conveying belt. Accordingly, with regard to the aforementioned technique (2), even if a speed variation of the photosensitive drum or the transfer material conveying belt is corrected, the eccentricity cannot be corrected.

SUMMARY OF THE INVENTION

The present invention is directed to an image forming technique facilitating misregistration correction regardless of a plurality of speed variation factors by detecting an overall amount of the speed variation factors.

According to an aspect of the present invention, an image forming apparatus includes an image carrier, a polygonal mirror drive motor configured to drive a polygonal mirror to scan the image carrier with a laser beam emitted from a light source, an intermediate transfer member configured to transfer thereto a toner image formed on the image carrier, a drive roller configured to drive the intermediate transfer member, wherein a perimeter of the intermediate transfer member is substantially an integral multiple of a perimeter of each of the image carrier and the drive roller, an intermediate transfer member position detection unit configured to detect a position of the intermediate transfer member to output an image forming operation start signal, a pattern detection unit configured to detect a registration correction pattern formed on the intermediate transfer member based on the image forming operation start signal, a misregistration variation detection unit configured to read the registration correction pattern detected by the pattern detection unit based on the image forming operation start signal and to generate a reference clock signal based on the read registration correction pattern, and a polygon motor control unit configured to adjust a rotation speed of the polygonal mirror drive motor based on the reference clock signal generated by the misregistration variation detection unit.

According to another aspect of the present invention, an image forming apparatus includes an image carrier, a polygonal mirror drive motor configured to drive a polygonal mirror to scan the image carrier with a laser beam emitted from a light source, a transfer material conveying member, a drive roller configured to drive the transfer material conveying member, wherein a perimeter of the transfer material conveying member is substantially an integral multiple of a perimeter of each of the image carrier and the drive roller, a transfer material conveying member position detection unit configured to detect a position of the transfer material conveying member to output an image forming operation start signal, a pattern detection unit configured to detect a registration correction pattern formed on the transfer material conveying member based on the image forming operation start signal, a misregistration variation detection unit configured to read the registration correction pattern detected by the pattern detection unit based on the image forming operation start signal and to generate a reference clock signal based on the read registration correction pattern, and a polygon motor control unit configured to adjust a rotation speed of the polygonal mirror drive motor based on the reference clock signal generated by the misregistration variation detection unit.

Further features and aspects of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will now herein be described in detail below with reference to the drawings.

First Exemplary Embodiment

Figure 1:
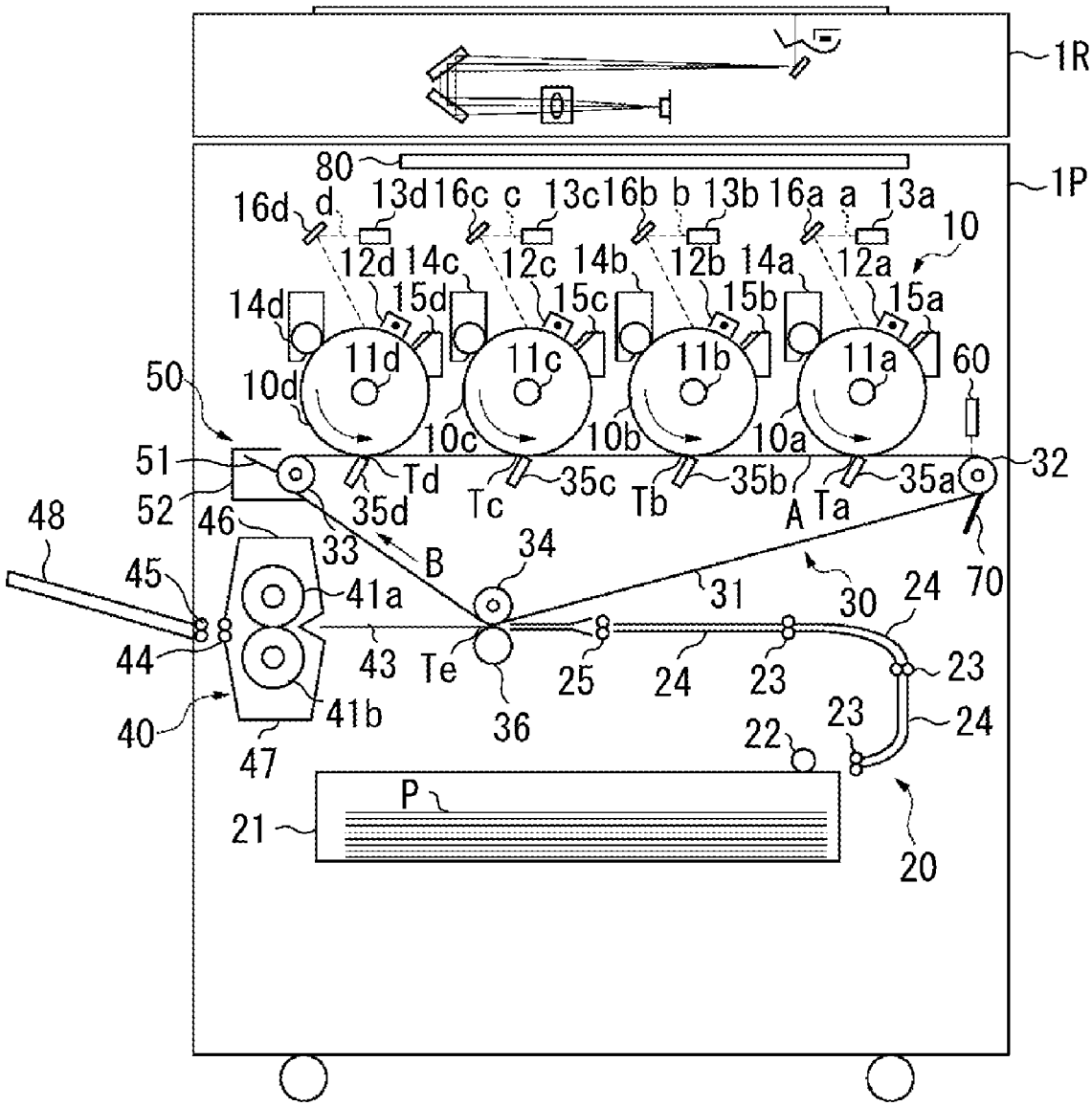
FIG. 1 illustrates an example configuration of an image forming apparatus according to an exemplary embodiment of the present invention.

FIG. 1 illustrates an example configuration of an image forming apparatus according to a first exemplary embodiment of the present invention. The image forming apparatus is a color image forming apparatus having a plurality of image forming sections arranged in a row and adopting an intermediate transfer method.

Referring to FIG. 1, the color image forming apparatus includes an image reading section 1R and an image output section 1P. The image reading section 1R optically reads an original image, converts it into electric signals, and sends the electric signals to the image output section 1P. The image output section 1P includes a plurality of image forming sections 10 (10*a*, 10*b*, 10*c*, and 10*d*) arranged in a row according to the present embodiment, a paper feed unit 20, an intermediate transfer unit 30, a fixing unit 40, a cleaning unit 50, photosensors 60 and 70, and a control unit 80.

Each of the image forming sections 10*a*, 10*b*, 10*c*, and 10*d* has a similar configuration and includes a drum-type electrophotographic photosensitive member serving as a first image carrier, i.e., a photosensitive drum 11 (11*a*, 11*b*, 11*c*, 11*d*), rotably supported by a shaft and rotatable in the direction of an arrow. Further, a primary charging unit 12, an optical system 13, a folding mirror 16, a development device 14, and a cleaning device 15 are arranged around the periphery of the photosensitive drum 11 in the order of the rotation direction of the photosensitive drum 11.

Thus, the image forming section 10*a*-10*d* includes the photosensitive drum 11*a*-11*d*, the primary charging unit 12*a*-12*d*, the optical system 13*a*-13*d*, the folding mirror 16*a*-16*d*, the development device 14*a*-14*d*, and the cleaning device 15*a*-15*d*.

The primary charging unit 12*a*-12*d* charges the surface of the photosensitive drum 11*a*-11*d* with an even amount of electric charge. Then, the optical system 13*a*-13*d* exposes the photosensitive drum 11*a*-11*d* to a light beam, e.g., a laser beam, modulated according to a recording image signal output from the image reading section 1R through the folding mirror 16*a*-16*d* to form an electrostatic latent image thereon.

The electrostatic latent image is then visualized by the development device 14*a*-14*d*, which contains a yellow, cyan, magenta, or black developer (hereinafter referred to as "toner"). The visual image is then transferred to a belt-type intermediate transfer member serving as a second image carrier, i.e., an intermediate transfer belt 31, constituting the intermediate transfer unit 30, at an image transfer area Ta, Tb, Tc, or Td. The intermediate transfer unit 30 will be described later in detail.

At the downstream side of the image transfer area Ta, Tb, Tc, or Td, the cleaning device 15*a*-15*d* cleans the surface of the photosensitive drum 11*a*-11*d* by scraping off toner remaining without transferring to the intermediate transfer belt 31. According to the above-described process, an image is formed one by one with each toner.

The paper feed unit 20 includes a cassette 21 which contains a transfer material P, a pickup roller 22 configured to pick up a transfer material P one by one from the cassette 21, and a paper feed roller pair 23 configured to convey the transfer material P picked up by the pickup roller 22. The paper feed unit 20 further includes a pair of paper feed guides 24 and a registration roller pair 25 configured to send the transfer material P to a secondary transfer area Te at an image forming timing of each image forming section 10.

The intermediate transfer unit 30 will now be described in detail. The intermediate transfer unit 30 includes the intermediate transfer belt 31. The intermediate transfer belt 31 is looped around a drive roller 32 which transmits driving force to the intermediate transfer belt 31, an idler roller 33 which provides an appropriate amount of tension to the intermediate transfer belt 31 with a spring (not shown), and a secondary transfer counter roller 34. Also, a primary transfer plane A is formed between the drive roller 32 and the idler roller 33.

The intermediate transfer belt 31 can be made from a material such as PET (polyethlene terephthalate) or PVdF (polyvinylidene difluoride). The drive roller 32 has a metal roller having a few milimeter-thick rubber (urethane or chloroprene) coated on its surface so as to prevent the intermediate transfer belt 31 from sliding. The drive roller 32 is rotated by a DC brushless motor (not shown).

At the primary transfer area Ta-Td, where the photosensitive drum 11*a*-11*d* and the intermediate transfer belt 31 face each other, a primary transfer charging unit 35 (35*a*-35*d*) is arranged on the inner side of the intermediate transfer belt 31. A secondary transfer roller 36 is arranged to face the secondary transfer counter roller 34 across the intermediate transfer belt 31 so that a secondary transfer area Te is formed at a nip between the intermediate transfer belt 31 and the secondary transfer roller 36. The secondary transfer roller 36 is pressed against the intermediate transfer belt 31 with an appropriate amount of pressure.

The cleaning unit 50 is configured to clean an image forming surface of the intermediate transfer belt 31 at the downstream side of the secondary transfer area Te of the intermediate transfer belt 31. The cleaning unit 50 includes a cleaning blade 51 configured to remove toner remaining on the intermediate transfer belt 31 and a waste toner box 52 configured to store collected waste toner.

The fixing unit 40 includes a fixing roller 41*a* having therein a heat source, such as a halogen heater, and a pressure roller 41*b* which is pressed against the fixing roller 41*a*. It is to be noted that the pressure roller 41*b* may also have a heat source. Further, the fixing unit 40 includes a conveying guide 43 configured to guide the transfer material P to a nip between the fixing roller 41*a* and the pressure roller 41*b*, and heat insulation covers 46 and 47 configured to keep therein heat dissipated from the fixing unit 40. Also, the fixing unit 40 includes an internal discharge roller 44 configured to guide a transfer material P that is discharged from the nip between the fixing roller 41*a* and the pressure roller 41*b* to the outside of the image forming apparatus. An external discharge roller 45 and a discharge tray 48, on which the transfer material P can be loaded, are arranged at the downstream side of the fixing unit 40.

An operation of the color image forming apparatus having the above-described configuration will now be described. The control unit 80 includes a central processing unit (CPU) configured to control operations of the various units described above, a registration correction circuit, a motor driver section, etc. The CPU is a microcontroller configured to control a drive load of the image output section 1P. The CPU executes a program stored in a read-only memory (ROM) or a random access memory (RAM), and sets a control signal to drive the image output section 1P.

When the CPU outputs an image forming operation start signal, a paper feed tray is selected according to the selected size of paper, etc., and a paper feed operation is started. FIG. 1 illustrates only one cassette, i.e., the cassette 21. However, the image forming apparatus can include a plurality of cassettes.

First, the transfer material P is picked up by the pickup roller 22 one by one from the cassette 21. Then, the transfer material P is guided between a pair of paper feed guides 24 by the paper feed roller pair 23 and conveyed to the registration roller pair 25. At that time, the registration roller pair 25 is not rotating. Thus, the edge of the transfer material P butts the nip.

After that, the image forming section 10 starts to form an image at a timing when the photosensor 70 detects a mark (not shown) made on the intermediate transfer belt 31. Also, at the same timing, the registration roller pair 25 starts rotating. Also, this timing is controlled so that the transfer material P matches a toner image primary-transferred to the intermediate transfer belt 31 by the image forming section 10 at the secondary transfer area Te at that timing. It is to be noted that a plurality of the aforementioned marks can also be used.

On the other hand, the image forming section 10 starts to form an image when an image forming operation start signal (ITOP), which is a mark detection signal from the photosensor 70, is output. To be more specific, a toner image which is formed on the photosensitive drum 11*d* disposed at the most upstream side of the intermediate transfer belt 31 in its rotation direction is primary-transferred to the intermediate transfer belt 31 at the primary transfer area Td by the primary transfer charging unit 35*d*, which is applied with a high voltage, according to the above-described process.

The primary-transferred toner image is conveyed to the next primary transfer area Tc. At the primary transfer area Tc, an image forming operation is started after a delay of a period of time corresponding to a travel time of the toner image between the image forming sections 10*d* and 10*c*. The next toner image is transferred to the intermediate transfer belt 31 while being aligned with the previously transferred toner image. A similar process is repeated until four color toner images are primary-transferred onto the intermediate transfer belt 31.

After that, the transfer material P enters the secondary transfer area Te and contacts the intermediate transfer belt 31. At the timing when the transfer material P passes the secondary transfer area Te, a high voltage is applied to the secondary transfer roller 36. Thus, the four-color toner image formed on the intermediate transfer belt 31 according to the above-described process is transferred onto the surface of the transfer material P. Then, the transfer material P is guided by the conveying guide 43 to the fixing nip where the fixing roller 41*a* and the pressure roller 41*b* contact.

The toner image is then fixed onto the surface of the transfer material P at the fixing nip with heat and pressure. Then, the transfer material P is conveyed by the internal discharge roller 44 and the external discharge roller 45 to be discharged to the discharge tray 48.

Figure 2:
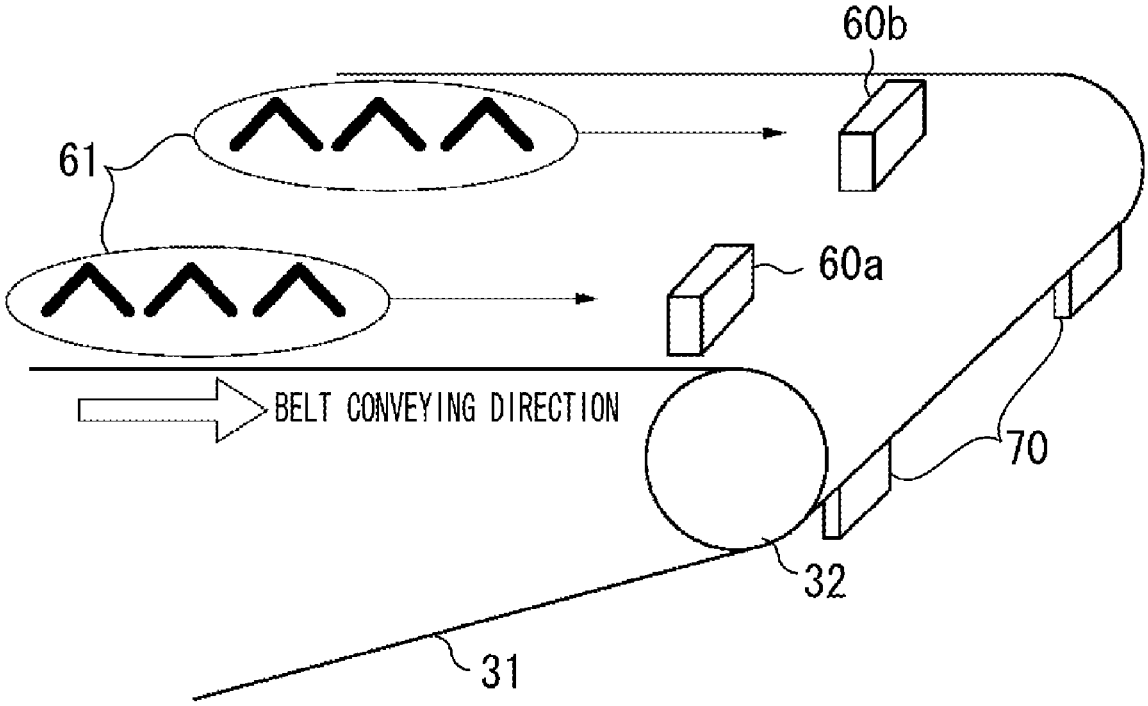
FIG. 2 illustrates an example first registration correction pattern formed on an intermediate transfer belt to correct a stationary misregistration according to an exemplary embodiment of the present invention.

An example registration correction will now be described. FIG. 2 illustrates a first registration correction pattern 61 formed on the intermediate transfer belt 31 illustrated in FIG. 1 to correct a stationary misregistration.

In FIG. 2, the photosensor 60 (60*a*, 60*b*), serving as a pattern image reading unit, is located between the photosensitive drum 11*a* disposed at the most downstream side of the intermediate transfer belt 31 and the drive roller 32. The photosensor 60 detects the first registration correction pattern 61 formed on the intermediate transfer belt 31.

According to the present embodiment, the first registration correction pattern 61 is formed on the intermediate transfer belt 31 at a predetermined timing. The photosensor 60 reads the first registration correction pattern 61 to detect any misregistration of images corresponding to the respective photosensitive drums 10 (10*a*-10*d*). Then, an image signal to be recorded is electrically corrected. Also, an optical path length change and an optical path change are corrected by driving the folding mirror 16*a*-16*d* located along a laser beam path. This is a correction for a stationary misregistration.

Figure 3A:
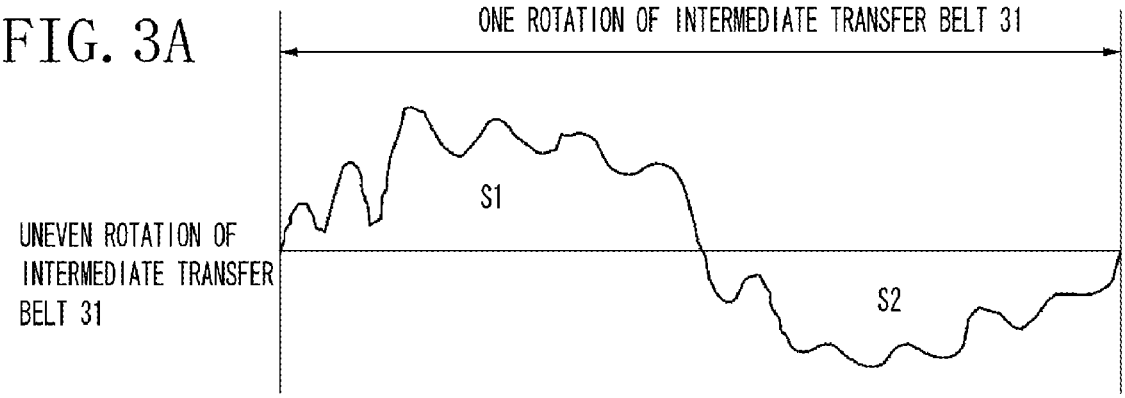
FIGS. 3A, 3B, and 3C illustrate an uneven rotation of the intermediate transfer belt, a drive roller, and a photosensitive drum according to an exemplary embodiment of the present invention.
Figure 3B:
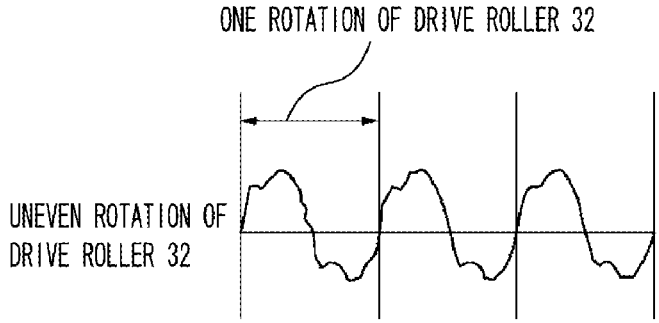
Figure 3C:
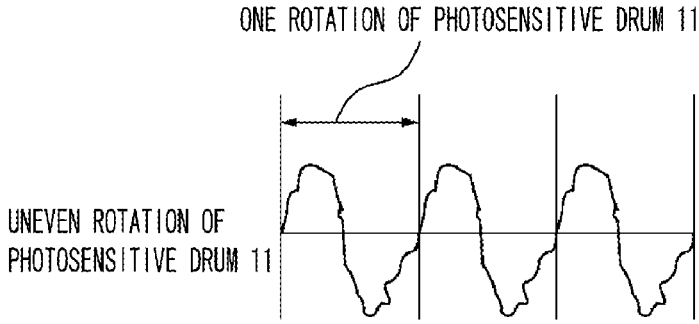

Next, an example correction of a periodic variable misregistration will now be described. There are three factors for a periodic variable misregistration or an uneven pitch having a specific periodicity:

(1) uneven rotation or uneven thickness of the intermediate transfer belt 31 (FIG. 3A), (2) uneven rotation of the intermediate transfer belt drive roller 32 (FIG. 3B), and (3) uneven rotation of the photosensitive drum 11 (FIG. 3C).

In the case of factor (1), when the intermediate transfer belt 31 makes one rotation, as illustrated in FIG. 3A, the area (S1) corresponding to an amount of uneven rotation larger than 0 equals the area (S2) corresponding to an amount of uneven rotation smaller than 0 (S2). Thus, the uneven rotation of the intermediate transfer belt 31 is approximated by a sine wave.

Figure 4:
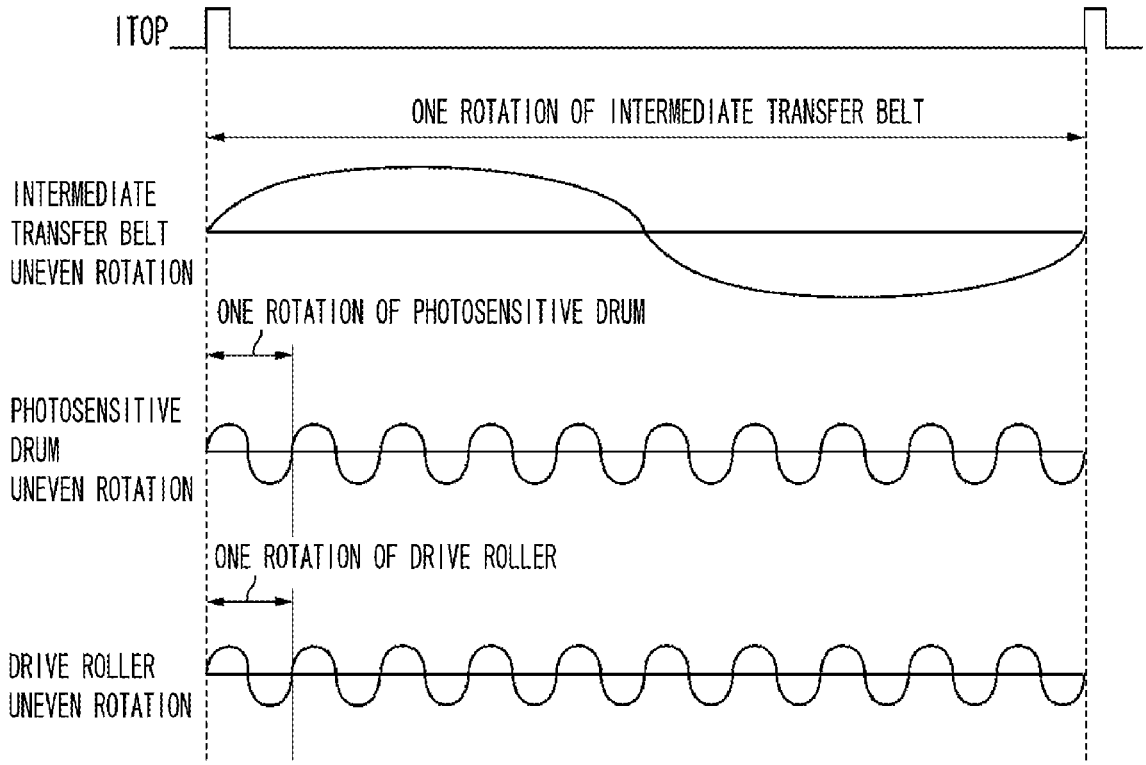
FIG. 4 illustrates an amount of uneven rotation of the intermediate transfer belt, the drive roller, and the photosensitive drum while the intermediate transfer belt makes one rotation according to an exemplary embodiment of the present invention.

Similarly, the uneven rotation of the intermediate transfer belt drive roller 32 in the case of factor (2) and the uneven rotation of the photosensitive drum 11 in the case of factor (3) are also approximated by a sine wave. The amount of uneven rotation of the intermediate transfer belt 31, the drive roller 32, and the photosensitive drum 11 when the intermediate transfer belt 31 makes one rotation is illustrated in FIG. 4. According to the present embodiment, the perimeter of the drive roller 32 is set to equal the perimeter of the photosensitive drum 11, and the perimeter of the intermediate transfer belt 31 is set to be an integral multiple of the perimeter of each of the photosensitive drum 11 and the drive roller 32.

For example, if the perimeter of the intermediate transfer belt 31 is 1200 mm, and the perimeter of each of the photosensitive drum 11 and the drive roller 32 is 120 mm, the photosensitive drum 11 and the drive roller 32 make 10 rotations while the intermediate transfer belt 31 makes one rotation. Their amount of uneven rotation can be expressed as illustrated in FIG. 4. Thus, the aforementioned factors (1)-(3) will always exhibit a similar phase in an ITOP cycle. A total of these uneven rotations result in misregistration or an uneven pitch in the image forming apparatus as a whole.

Figure 5:
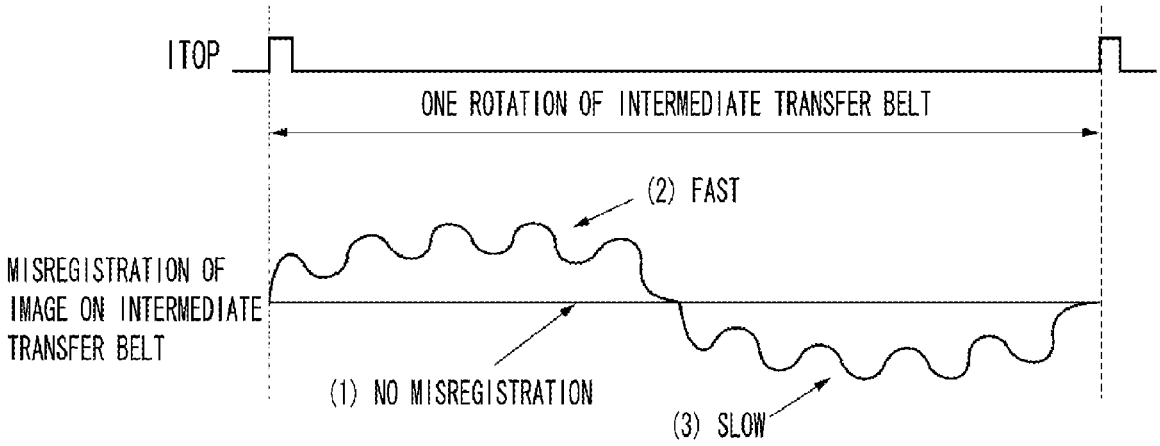
FIG. 5 illustrates an overall amount of misregistration of an image while the intermediate transfer belt makes one rotation according to an exemplary embodiment of the present invention.

FIG. 5 illustrates an overall amount of misregistration of an image while the intermediate transfer belt 31 makes one rotation. In FIG. 5, if there is no misregistration, the amount of misregistration stays at 0 as indicated with (1) "no misregistration". However, actually, the amount of misregistration changes as indicated with curves (2) and (3). The curve (2) indicates an image advancing faster with respect to the regular position while the curve (3) indicates an image advancing slower with respect to the regular position.

Figure 6:
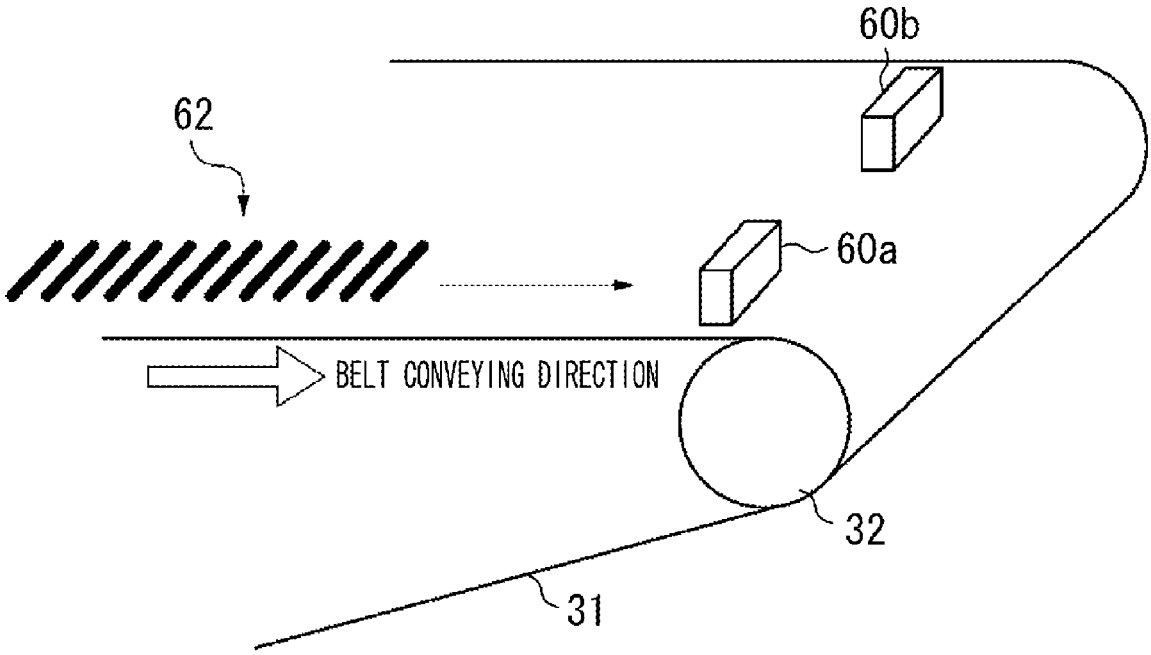
FIG. 6 illustrates a second example registration correction pattern formed on the intermediate transfer belt to correct a periodic variable misregistration according to an exemplary embodiment of the present invention.

The above-described amount of misregistration occurring at regular intervals can be detected using a registration correction pattern. FIG. 6 illustrates a second registration correction pattern 62 formed on the intermediate transfer belt 31 to correct a variable misregistration having a periodicity.

In FIG. 6, the second registration correction pattern 62 has a plurality of equally-spaced lines formed perpendicular to the conveying direction of the intermediate transfer belt 31. If a variable misregistration or uneven pitch occurs, the second registration correction pattern 62 will be detected as not equally spaced.

The second registration correction pattern 62 needs to be formed and detected for one rotation of the intermediate transfer belt 31. In addition, the second registration correction pattern 62 needs to be generated and detected for each color or each of the photosensitive drums 11*a*-11*d*. However, if the speed variation of the photosensitive drums 11*a*-11*d* is the same, only one second registration correction pattern 62 will be required.

Figure 7:
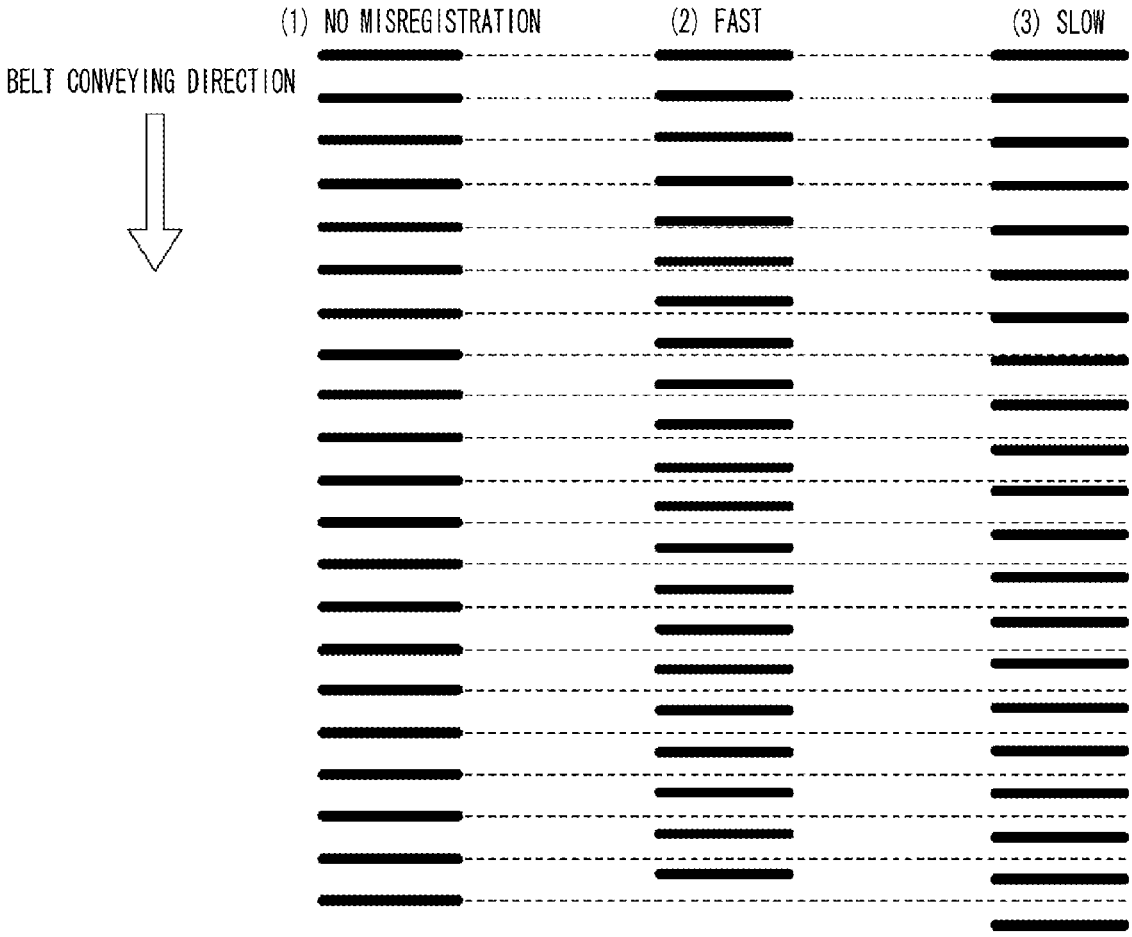
FIG. 7 illustrates a second example registration correction pattern which is out of alignment according to an exemplary embodiment of the present invention.

FIG. 7 illustrates a second registration correction pattern 62 indicating misregistration with respect to the regular position. In FIG. 7, if there is no misregistration as indicated with case (1), the lines are equally spaced. The case (2) indicates that the lines advance faster compared to the case (1). If the rotation speed of a polygonal mirror drive motor 105 shown in FIG. 8 (to be discussed later in greater detail) is constant, the case indicates that an overall conveying speed of the photosensitive drum 11, the drive roller 32, and the intermediate transfer belt 31 is slow. The case (3) indicates that the lines advance slower compared to the case (1). Thus, the case (3) indicates that the overall conveying speed is fast. Accordingly, detecting a change in the spacing based on the ITOP cycle enables detecting a variable misregistration or an uneven pitch that varies periodically.

Figure 8:
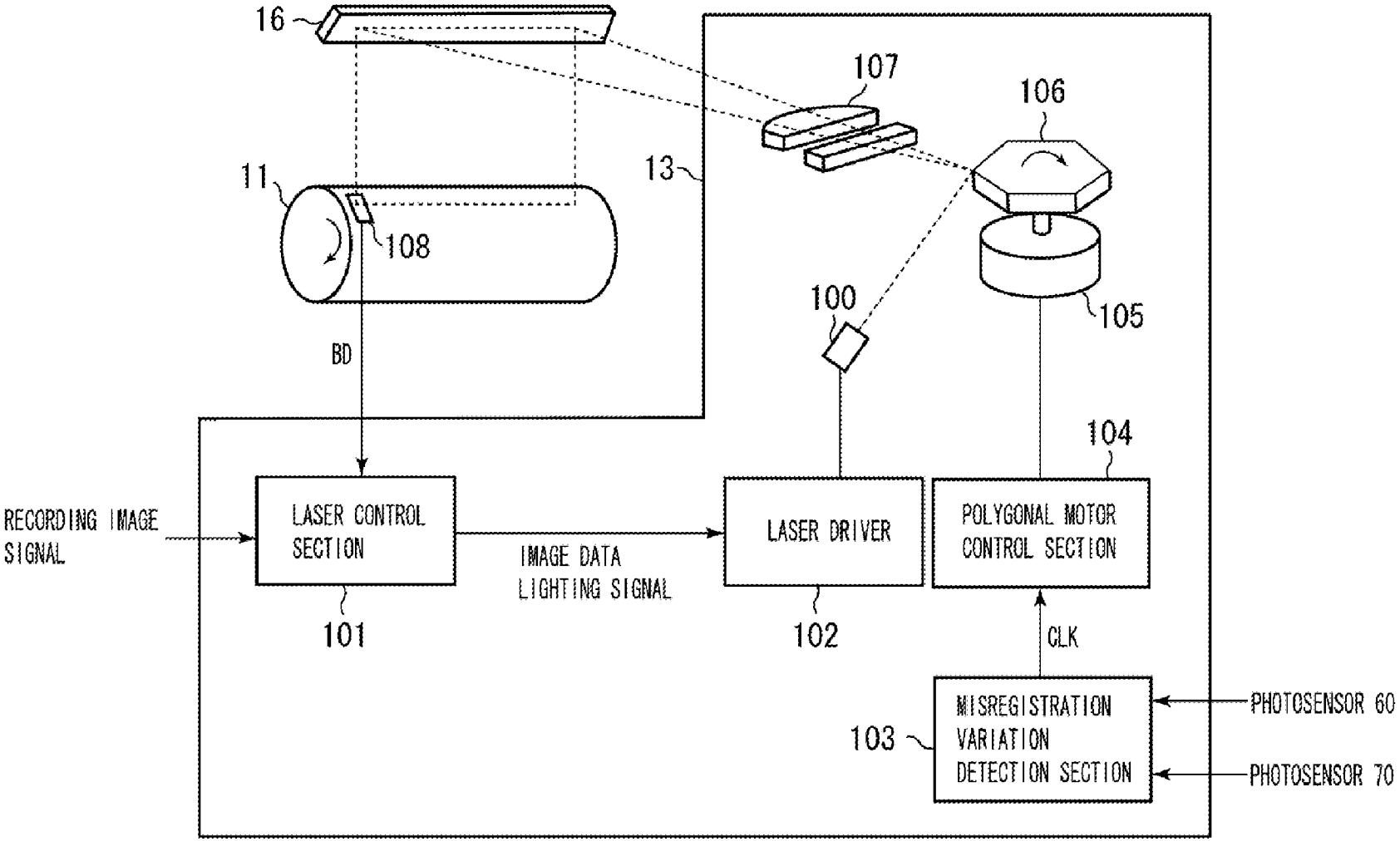
FIG. 8 illustrates an example configuration of an optical system of the image forming apparatus according to an exemplary embodiment of the present invention.

FIG. 8 illustrates an example configuration of an optical system 13 of the color image forming apparatus illustrated in FIG. 1. In FIG. 8, the optical system 13 includes a laser diode 100, a laser control section 101, a laser driver 102, a misregistration variation detecting section 103, a polygon motor control section 104, a polygonal mirror drive motor 105, a polygon mirror 106, and an f-theta (f-θ) lens 107.

A recording image signal output from the image reading section 1R is sent to the laser control section 101. The laser control section 101 generates an image data lighting signal at a predetermined timing according to the recording image signal. The laser driver 102 drives the laser diode 100 according to the image data lighting signal output from the laser control section 101.

A laser beam emitted from the laser diode 100 is reflected by the polygonal mirror 106, which is being rotated in the direction of an arrow by the polygonal mirror drive motor 105 controlled by the polygon motor control section 104. The laser beam scans the photosensitive drum 11 after being corrected by the f-theta lens 107 and reflected by the folding mirror 16.

In this way, an electrostatic latent image is formed on the photosensitive drum 11. A beam detection (BD) sensor 108 is located in the vicinity of a scanning start point where a laser beam starts scanning. The BD sensor 108 detects a line scan start position of each laser beam to output a BD signal. The BD signal serves as a scan start reference signal for the laser control section 101 to start scanning. Besides generating an image data lighting signal, the laser control section 101 also generates and outputs a laser forcible lighting signal for detecting a BD signal to the laser driver 102 to forcibly turn on the laser diode 100.

The polygonal mirror drive motor 105 rotates by generating a rotating magnetic field. According to an output of a Hall sensor which detects a rotation angle of a rotor, a logic circuit generates a logic of a rotating magnetic field. By a group of bridged semiconductor devices performing switching, electric current is supplied to a coil which generates the rotating magnetic field. The polygonal mirror drive motor 105 rotates at a speed (at a rotational frequency) according to a cycle of a reference clock signal (CLK) output from the misregistration variation detecting section 103.

The misregistration variation detecting section 103 stores an output of the photosensor 60 detecting the second registration correction pattern 62 for detecting a variable misregistration based on the ITOP signal detected by the photosensor 70. Further, based on the result of the detection, the misregistration variation detecting section 103 generates a reference clock signal (CLK) for determining a rotation speed of the polygonal mirror drive motor 105 and outputs the reference clock signal to the polygon motor control section 104.

If there is no misregistration, the reference clock signal keeps a constant cycle. However, if there is a misregistration as illustrated in FIG. 5, a reference clock signal corresponding to such misregistration is generated. In other words, at the curve (2) indicating fast image advancing, where the conveying speed is slow, the frequency of the reference clock signal is lowered so that the rotation speed of the polygonal mirror drive motor 105 becomes slower. As for the curve (3) indicating slow image advancing, where the conveying speed is fast, the frequency of the reference clock signal is made higher so that the rotation speed of the polygonal mirror drive motor 105 becomes higher.

Figure 9:
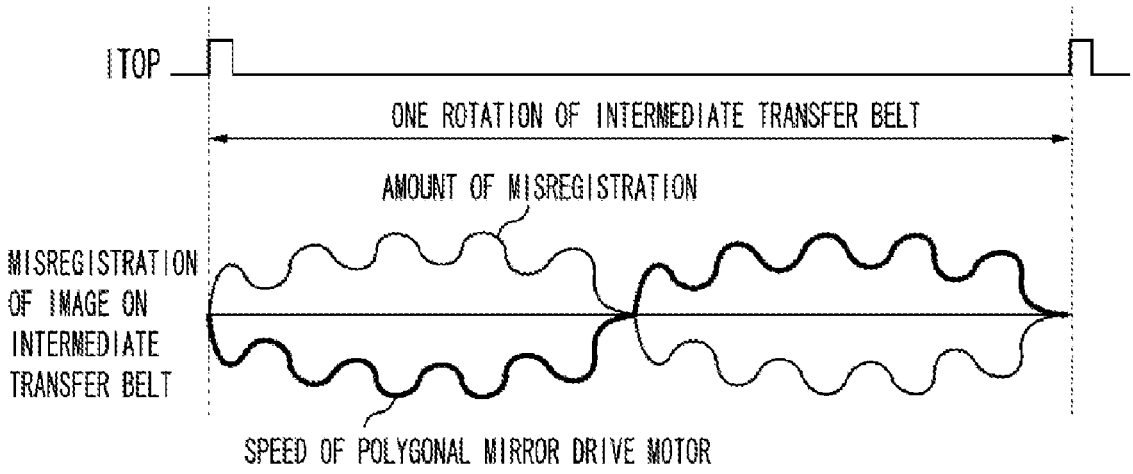
FIG. 9 illustrates a speed variation of a polygonal mirror drive motor illustrated in FIG. 8.

This means that, as illustrated in FIG. 9, the speed of the polygonal mirror drive motor 105 is set so that the speed is in phase but in reverse displacement with respect to the amount of misregistration of an image on the intermediate transfer belt 31 based on the ITOP cycle. As a result, no image misregistration will occur on the intermediate transfer belt 31.

According to the present embodiment, the perimeter of the drive roller 32 is set to equal the perimeter of the photosensitive drum 11, and the perimeter of the intermediate transfer belt 31 is set to be an integral multiple of the perimeter of each of the photosensitive drum 11 and the drive roller 32. However, each of the drive roller 32 and the photosensitive drum 11 may make an integral number of rotations while the intermediate transfer belt 31 makes one rotation.

Furthermore, a similar effect may also be acquired when the aforementioned perimeter is not an exact integral multiple but substantially an integral multiple. While the present embodiment is directed to a color image forming apparatus having the intermediate transfer belt 31, the present invention is also applicable to a color image forming apparatus having a transfer material conveying belt configured to convey a transfer material P. In addition, the present invention is also applicable to a color image forming apparatus including an optical system having a plurality of polygonal mirror drive motors 105 and a plurality of polygonal mirrors 106.

While the present embodiment is directed to a color image forming apparatus having a plurality of image forming sections, the present invention is also applicable to a single-drum-type color image forming apparatus having a single image forming section.

Second Exemplary Embodiment

Figure 10:
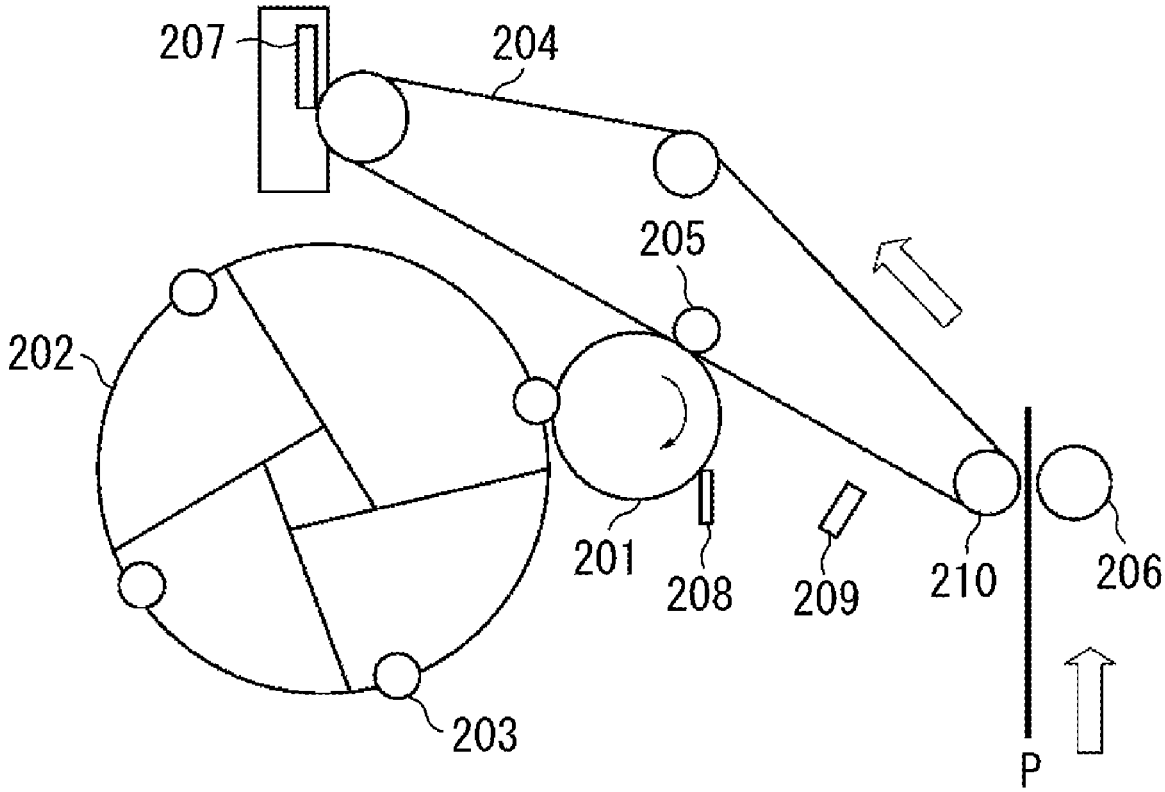
FIG. 10 illustrates a configuration of an image forming system of the image forming apparatus according to an exemplary embodiment of the present invention.

FIG. 10 illustrates a configuration of an image forming apparatus according to a second exemplary embodiment of the present invention.

In FIG. 10, a photosensitive drum 201 is in contact with a multicolor developing unit (four-color developing rotary) 202 and an intermediate transfer belt 204. A laser beam corresponding to an image data signal which is output from a laser scanner (not shown) is emitted onto the photosensitive drum 201. According to a clockwise rotation of the photosensitive drum 201, an electrostatic latent image formed on the photosensitive drum 201 is delivered to one of four color developing sleeves 203 of the multicolor developing unit 202.

Toner corresponding to a potential formed between the surface of the photosensitive drum 201, where the electrostatic latent image is formed, and the surface of the developing sleeve 203, where a developing bias is applied, is attracted to the surface of the photosensitive drum 201 from the color developing unit 202. Thus, the electrostatic latent image formed on the surface of the photosensitive drum 201 is developed.

The toner image formed on the photosensitive drum 201 is transferred to the intermediate transfer belt 204 according to the clockwise rotation of the photosensitive drum 201. The intermediate transfer belt 204 rotates counterclockwise according to the rotation of a drive roller 210. If the image is black and white, images are sequentially formed on the intermediate transfer belt 204 at a predetermined time interval and then primary-transferred by a primary transfer roller 205.

In the case of a full-color image, positioning of developing sleeves 203 are sequentially performed for the respective electrostatic latent images for colors on the photosensitive drum 201, and the images are developed and primary-transferred. The primary transfer of the full-color image is completed when the intermediate transfer belt 204 makes four rotations or after the primary transfer for four colors is finished.

The transfer material P is conveyed between the secondary transfer roller 206 and the intermediate transfer belt 204 towards a fixing unit (not shown) and then pressed against the intermediate transfer belt 204. Thus, the toner image on the intermediate transfer belt 204 is secondary-transferred onto the transfer material P.

Residual toner particles remaining on the intermediate transfer belt 204 without being transferred onto the transfer material P are cleaned by a cleaning blade 207, which can contact the surface of the intermediate transfer belt 204. Residual toner particles remaining on the photosensitive drum 201 are scraped off by a blade 208 and conveyed to a waste toner box (not shown) integrated in a photosensitive drum unit.

A photosensor 209 is configured to detect a registration correction pattern formed on the intermediate transfer belt 204. As in the first exemplary embodiment, controlling the speed of a polygonal mirror drive motor (not shown) based on detection of misregistration enables reducing misregistration on the intermediate transfer belt 204.

According to the present embodiment, as in the first exemplary embodiment, the photosensitive drum 201 and the drive roller 210 may make an integral number of rotations while the intermediate transfer belt 204 makes one rotation. Furthermore, in the present embodiment, since a single photosensitive drum 201 is used, only a registration correction pattern for one color is required. Also, although the present embodiment is directed to a color image forming apparatus having an intermediate transfer belt, the present invention is applicable to a color image forming apparatus having a transfer material conveying belt configured to convey a transfer material P.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2006-136961 filed May 16, 2006, which is hereby incorporated by reference herein in its entirety.

What is claimed is:

1. An image forming apparatus comprising:

an image carrier;

a polygonal mirror drive motor configured to drive a polygonal mirror to scan the image carrier with a laser beam emitted from a light source;

an intermediate transfer member configured to transfer thereto a toner image formed on the image carrier;

a drive roller configured to drive the intermediate transfer member, wherein a perimeter of the intermediate transfer member is substantially an integral multiple of a perimeter of each of the image carrier and the drive roller;

an intermediate transfer member position detection unit configured to detect a position of the intermediate transfer member to output an image forming operation start signal;

a pattern detection unit configured to detect a registration correction pattern formed on the intermediate transfer member based on the image forming operation start signal;

a misregistration variation detection unit configured to read the registration correction pattern detected by the pattern detection unit based on the image forming operation start signal and to generate a reference clock signal based on the read registration correction pattern; and a polygonal mirror drive motor control unit configured to adjust a rotation speed of the polygonal mirror drive motor based on the reference clock signal generated by the misregistration variation detection unit.

2. The image forming apparatus according to claim 1, wherein the registration correction pattern includes a first registration correction pattern for correcting a stationary misregistration and a second registration correction pattern for correcting a periodic misregistration.

3. An image forming apparatus comprising:

a plurality of image carriers;

a plurality of polygonal mirror drive motors each configured to drive a polygonal mirror to scan each image carrier with a laser beam emitted from a light source image;

an intermediate transfer member configured to transfer thereto a toner image formed on each image carrier;

a drive roller configured to drive the intermediate transfer member, wherein a perimeter of the intermediate transfer member is substantially an integral multiple of a perimeter of each of the plurality of image carriers and the drive roller;

an intermediate transfer member position detection unit configured to detect a position of the intermediate transfer member to output an image forming operation start signal;

a pattern detection unit configured to detect a registration correction pattern formed on the intermediate transfer member based on the image forming operation start signal;

a misregistration variation detection unit configured to read the registration correction pattern detected by the pattern detection unit based on the image forming operation start signal and to generate a reference clock signal based on the read registration correction pattern; and a polygonal mirror drive motor control unit configured to adjust a rotation speed of each of the plurality of polygonal mirror drive motors based on the reference clock signal generated by the misregistration variation detection unit.

4. The image forming apparatus according to claim 3, wherein the registration correction pattern includes a first registration correction pattern for correcting a stationary misregistration and a second registration correction pattern for correcting a periodic misregistration.

5. An image forming apparatus comprising:

an image carrier;

a polygonal mirror drive motor configured to drive a polygonal mirror to scan the image carrier with a laser beam emitted from a light source;

a transfer material conveying member;

a drive roller configured to drive the transfer material conveying member, wherein a perimeter of the transfer material conveying member is substantially an integral multiple of a perimeter of each of the image carrier and the drive roller;

a transfer material conveying member position detection unit configured to detect a position of the transfer material conveying member to output an image forming operation start signal;

a pattern detection unit configured to detect a registration correction pattern formed on the transfer material conveying member based on the image forming operation start signal;

a misregistration variation detection unit configured to read the registration correction pattern detected by the pattern detection unit based on the image forming operation start signal and to generate a reference clock signal based on the read registration correction pattern; and a polygonal mirror drive motor control unit configured to adjust a rotation speed of the polygonal mirror drive motor based on the reference clock signal generated by the misregistration variation detection unit.

6. The image forming apparatus according to claim 5, wherein the registration correction pattern includes a first registration correction pattern for correcting a stationary misregistration and a second registration correction pattern for correcting a periodic misregistration.

7. An image forming apparatus comprising:

a plurality of image carriers;

a plurality of polygonal mirror drive motors each configured to drive a polygonal mirror to scan each image carrier with a laser beam emitted from a light source image;

a transfer material conveying member;

a drive roller configured to drive the transfer material conveying member, wherein a perimeter of the transfer material conveying member is substantially an integral multiple of a perimeter of each of the plurality of image carriers and the drive roller;

an transfer material conveying member position detection unit configured to detect a position of the transfer material conveying member to output an image forming operation start signal;

a pattern detection unit configured to detect a registration correction pattern formed on the transfer material conveying member based on the image forming operation start signal;

a misregistration variation detection unit configured to read the registration correction pattern detected by the pattern detection unit based on the image forming operation start signal and to generate a reference clock signal based on the read registration correction pattern; and a polygonal mirror drive motor control unit configured to adjust a rotation speed of each of the plurality of polygonal mirror drive motors based on the reference clock signal generated by the misregistration variation detection unit.

8. The image forming apparatus according to claim 7, wherein the registration correction pattern includes a first registration correction pattern for correcting a stationary misregistration and a second registration correction pattern for correcting a periodic misregistration.

* * * * *